United States Patent [19]
Henriot
[11] 4,220,946
[45] Sep. 2, 1980

[54] DEVICE FOR CONTROLLING THE RUNNING OF URBAN TRANSPORT VEHICLES

[75] Inventor: Christophe Henriot, Crepy en Valois, France

[73] Assignee: L'Electronique des Vehicules et des Reseaux (E.V.R.), Aubervilliers, France

[21] Appl. No.: 898,249

[22] Filed: Apr. 20, 1978

[30] Foreign Application Priority Data

Apr. 21, 1977 [FR] France ..... 77 12000

[51] Int. Cl.[2] ..... G08G 1/12; G08G 1/07

[52] U.S. Cl. ..... 340/23; 340/32; 364/436

[58] Field of Search ..... 340/23, 37, 24, 32; 343/112 TC, 112 PT, 102, 112 D; 364/436, 460; 246/117, 64, 111, 115; 246/167 R, 167 D, 174, 175

[56] References Cited

U.S. PATENT DOCUMENTS

| | | | |
|---|---|---|---|
| 2,656,528 | 10/1953 | Savino | 340/23 |
| 3,568,161 | 3/1971 | Knickel | 340/24 |
| 3,644,883 | 2/1972 | Borman et al. | 340/23 |
| 3,886,515 | 5/1975 | Cottin et al. | 340/23 |
| 4,009,375 | 2/1977 | White et al. | 364/436 |

FOREIGN PATENT DOCUMENTS

| | | | |
|---|---|---|---|
| 2347724 | 4/1975 | Fed. Rep. of Germany | 340/23 |
| 1521521 | 4/1968 | France . | |
| 2185824 | 1/1974 | France . | |
| 2301055 | 9/1976 | France . | |
| 2319947 | 2/1977 | France . | |

*Primary Examiner*—John W. Caldwell, Sr.
*Assistant Examiner*—James J. Groody
*Attorney, Agent, or Firm*—Sughrue, Rothwell, Mion, Zinn and Macpeak

[57] ABSTRACT

A system for controlling the running of urban transport vehicles, such as buses or trams, which stop at many stops is disclosed. The system includes recording and signalling beacons spaced out along the route of the vehicles and transmission units (2) disposed on each vehicle for transmitting data to the beacons. The data transmitted identifies the vehicle on the route and the optimum time interval before the arrival of the next vehicle. The beacons are each fitted with a clock and with a logic system (5) for comparing the optimum and real intervals between the arrivals of two vehicles, and with lights (7,9) indicating to the driver of a vehicle that he is early or late in relation to the optimum interval.

5 Claims, 4 Drawing Figures

1 4 21 88 13.65

DEVICE FOR CONTROLLING THE RUNNING OF URBAN TRANSPORT VEHICLES

FIELD OF THE INVENTION

The present invention relates to a system for controlling the running of transport vehicles which stop at numerous stops.

BACKGROUND OF THE INVENTION

Continuous control systems, for example for bus or tram networks include a single control center for all the routes of the network and each vehicle must be provided with two-way communication means with the control center, to inform the latter of its position and possibly to receive instructions for correcting its run.

The present invention aims to provide a system for controlling the running of urban transport vehicles which do not use a complex transmission system between each vehicle and a control center and yet allowing the run of any vehicle to be speeded up or slowed down on its route as a function of the distance which separates the vehicle from the preceding vehicle and possibly of other variable factors.

SUMMARY OF THE INVENTION

The system according to the invention comprises recording and signalling beacons spaced out along the route of the vehicles and data transmission units disposed on each vehicle for transmitting data to the beacons, said data including at least the identification of the vehicle, its route and the optimum time for the next vehicle to pass, characterized in that said beacons are each fitted with a clock and with means for comparing the optimum and real intervals between the passage of two successive vehicles and with means for indicating to the driver of a vehicle how early or late he is in relation to said optimum interval.

It also includes preferably at least one of the following characteristics.

The beacons are disposed at vehicle stops.

The ground beacons are disposed at road junctions regulated by traffic lights and are fitted with means for controlling the traffic lights to give priority to a vehicle which is late in relation to its optimum passage time.

Each vehicle is fitted with a memory of its theoretical passage times at each beacon and each beacon is fitted with means for comparing said theoretical passage time with the actual time and with means for controlling the traffic lights allowing a priority to a vehicle which is late in relation to its theoretical passage time, even if it passes by the beacon within the optimum time in relation to the preceding vehicle or in advance with respect to this time.

At least some stops are fitted with means for displaying the time in which the next vehicle should arrive at the stop connected to the nearest upstream beacon on the route of the vehicles.

The beacons are fitted with units for transmitting data to a control station of the urban transport network or of a part thereof.

Each vehicle is fitted with means for counting the number of passengers which it transports at a given instant and with means for transmitting this number to the beacons.

The data recorded by each vehicle and which is transmitted to the beacons can be more complete. It can also include the direction of the vehicle. The vehicle and the beacon communicate either by a radar system or by a radio system or by any other system for transmission between a moving vehicle and a fixed point.

After a vehicle has passed by a beacon, this beacon is capable when the next vehicle passes alongside it, of detecting whether it is early or late in relation to the stipulated interval. If the vehicle is early, this can be indicated by a fixed signal, for example a small red light which indicates to the driver that he must wait a certain number of seconds until the red light goes out. It is then sure that he will not accidentally catch up with the preceding vehicle; (this would lead to overloading the next vehicle, as frequently happens when the intervals between vehicles are not regulated, especially during rush hours). If, on the contrary, the vehicle which comes alongside the beacon is late in relation to the stipulated interval, the driver is informed by another fixed signal, for example a little green light. Further, if the beacon is placed near a road junction, it can then arrange for traffic lights at the junction to change to green in the direction of travel of the vehicle. It is observed that this system is more favourable to the steady flow of general traffic than are systems or regulations which systematically give priority to public transport traffic, which only needs its priority where such a vehicle is late in relation to the preceding vehicle or to its theoretical schedule. Further, the driver who arrives beside each beacon is informed automatically of his position in relation to the preceding vehicle and possibly of his situation in relation to his theoretical schedule and the running of his vehicle will be made easier if it is late.

The auxiliary system which provides some or all stops with means of displaying when the next vehicle should arrive at the stop is valuable for passengers, who will thus know how long they have to wait for the next vehicle.

The system in accordance with the invention is entirely compatible with a general control of the network or of a fraction of the network by a central station. In this case, the beacons are linked to the central station either by telephone lines or by radio. Extra information (for example concerning the load of a vehicle, which can be measured by automatic checking of tickets on boarding and alighting) can be transmitted by the vehicles to the beacons, which will then preferably be interrogated cyclically by the central station.

The auxiliary system which makes it possible to compare the theoretical time of arrival of each vehicle beside a beacon with the real time of arrival makes it possible to prevent all the vehicles of one route from being late should one of them become late. The signal concerning lateness in relation to the theoretical schedule then has priority over the signal concerning lateness in relation to the normal arrival interval after the preceding vehicle.

It will be observed that the system in accordance with the invention makes it possible either to speed up the run of a late vehicle and to slow down that of an early vehicle, or on the contrary simply to inform a central station of the presence of a late vehicle or of the fact that it has not yet arrived. The central station can then take appropriate measures, taking into account the information it has concerning the other vehicles on the same route.

The present invention also provides a system for controlling the running of urban public transport vehicles, including registering and signalling beacons spaced out along the route of the vehicles and units for transmitting data to the beacons disposed on each vehicle, said data comprising the identification of the vehicle and its route, its direction and the interval provided with respect to the next vehicle, characterized in that said data also includes the measurement of the real travel time since the departure from the terminus, by means of the clock disposed on board the vehicle and in that said beacons each fitted with a clock include means of recording the data of the theoretical travel time and of the maximum theoretical travel time and means of comparing and counting said theoretical time, said maximum theoretical time, said real travel time and said interval as well as means for controlling the traffic lights at road junctions as a function of said comparisons.

According to another particularity of the invention said comparing and counting means comprise a comparator which compares said real travel time with said maximum theoretical time and which delivers at its output data equal to 1 or 0 according to the result of the comparison, a set of up-down counters associated with clocks and a control unit making additions and substractions such as the following:

Theoretical travel time
+Inter-bus interval
−Real travel time
=Waiting time before the arrival of the next bus, said data 1 allowing the result of the additions and subtractions to be taken into account, said 0 allowing said interval only to be taken into account, said control unit further allowing a late bus announcement data to be sent to the traffic lights when said waiting period is ended as well as half the time corresponding to said interval since the passage of the preceding vehicle, said late bus announcement data being stopped after a time equal to a multiple of said interval or to the passage of the late bus.

There is described hereinbelow by way of an example and with reference to the accompanying drawings a system for controlling the running of urban transport buses.

DESCRIPTION OF PREFERRED EMBODIMENTS

Figure 1:
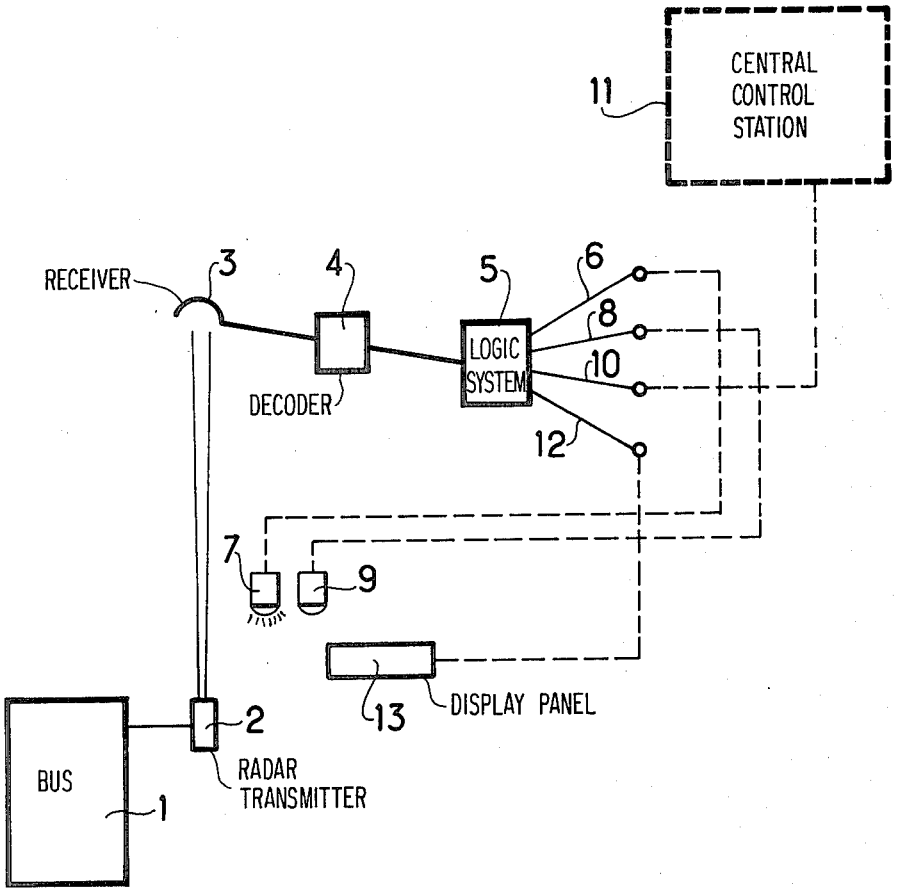
FIG. 1 is a block diagram of a system for controlling the running of urban transport buses.

A bus 1 is fitted with a radar transmitter 2 which emits a modulated beam. This modulated beam is received by a receiver 3 when the bus passes in front of a beacon. The receiver 3 is connected to a decoder 4 placed on the beacon. The message which is transmitted by the radar transmitter 2 includes a first number (at the bottom left-hand corner of the figure) which indicates the direction of movement of the bus, a second number which is the number of the route, for example 4, a third number which is the number of the bus on the route, for example N° 21 and a fourth number which gives the time in tens of seconds in which the following bus is due, for example 88. This bus will always announce the same four numbers along the route. Finally the radar transmitter finally transmits a fifth number, which is variable, which corresponds to the elapsed time of the bus journey along the route, for example 13.65.

All the receivers which receive the message from this bus will take note thereof and will start a counter which will count the 88 tens of seconds. Each time a following bus passes before the end of the fixed period and if the theoretical passing time transmitted by the bus is later than the time indicated by the clock of the beacon, (if the simultaneous fulfilling of these two conditions is presumed to be necessary for generating a slowing down order to the vehicle), the logic system 5 connected to the decoder will, by means of its output 6, cause a red light 7 to be turned on which will make the bus wait before it leaves the stop or will give it priority at the traffic lights, according to the position of the beacon. If, on the contrary, the bus is late with respect to the fixed period or to its schedule, the logic system will, by means of its output 8, cause a green light 9 to be turned on or will give the bus priority at the traffic lights. The logic system 5 is linked by an output 10 to a telephone or radio network for transmitting data which has just been stored therein to a central control station shown schematically by the rectangle 11. The logic system is also connected by its output 12 to a display panel 13 which can easily be seen by passengers, on which is shown the waiting time before the following bus is due.

Figure 2:
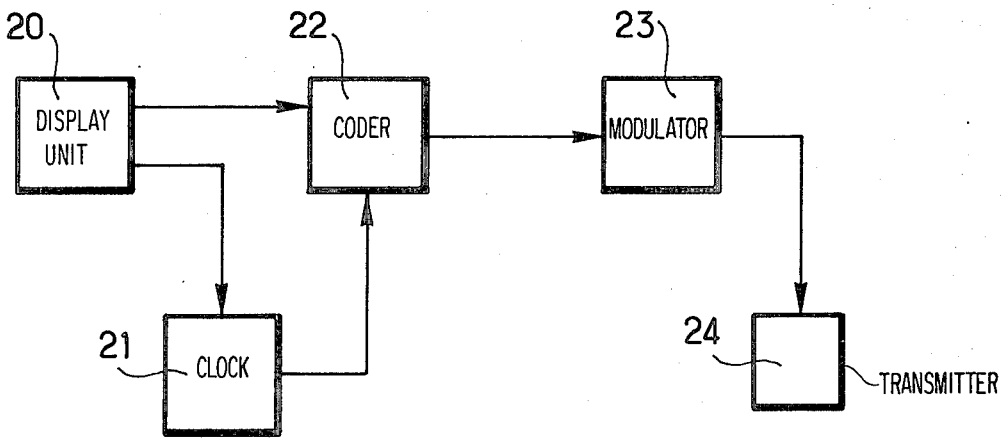
FIG. 2 is a block diagram of the electronic equipment of a bus in accordance with a variant.

As shown in FIG. 2, there is, on board the bus, a display unit 20 constituted by coding wheels which makes it possible to display: the route number, the bus number, the anticipated time before the following bus, the direction, and the starting of a clock 21 for measuring the elapsed journey time. The display unit 20 is connected firstly to the clock 21 which allows the travel time to be measured by measuring the time since the departure from the terminus and secondly to a coder 22 whose function is to organize the signals which come from the clock 21 and from the display unit 20 so as to be able to transmit them in series and to give the data which will make it possible for the receiver to receive the message. The signals of the coder 22 feed a modulator 23 whose function is to effect a frequency multiplex controlled by the logic signals. The modulator 23 is connected to a transmitter 24 which transmits on a frequency of 9.9 GHz for example and whose aerial is disposed on the roof of the bus. In this way, there is an electromagnetic link with the bus only by line of sight.

Figure 3:
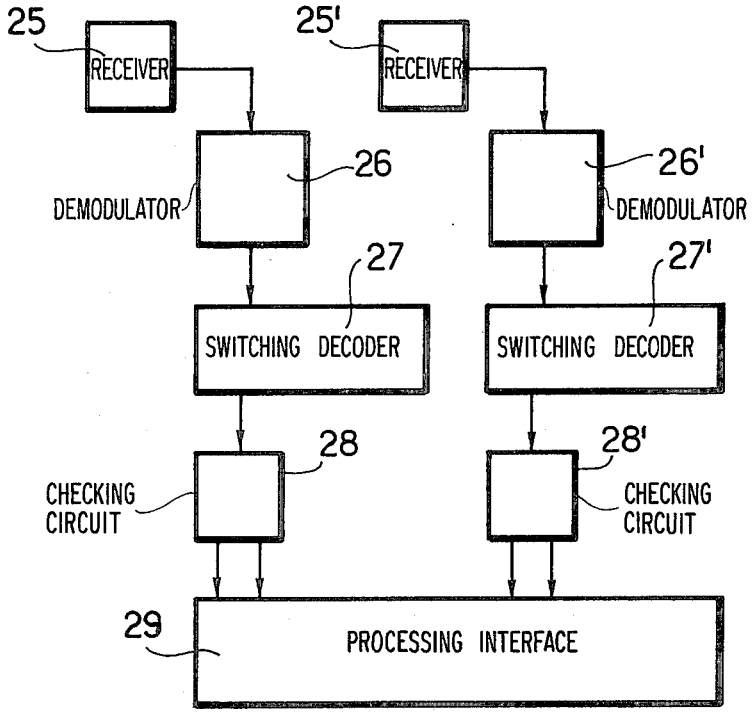
FIG. 3 is a block diagram of the electronic equipment of the beacon in accordance with the same variant.

In FIG. 3, which shows the beacon equipment, there is at least one receiver 25 tuned to the frequency of the transmitter 24 and whose signals are processed by a demodulator 26 which restores the data in its logic form, said logic signals being sent on a switching decoder 27. The decoder 27 is used for recognizing the signals received and to switch them as a function of the route number, the direction and the bus number. The route number and the direction are set by switches. When the bus number is different from that received at the preceding message, an "Arrival of a New Bus" signal is generated.

The switching decoder 27 sends the data to an early/-late checking circuit 28 constituted mainly by up-down counters associated with clocks and by a checking unit with programmable read only memories which are capable of controlling, among other functions, the upcounting and the down-counting of the counters. The signals of the early/late checking circuit 28 are sent on a processing interface 29 which also receives the states of the lights at the cross-roads and whose function is to integrate local traffic requirements and the requirements for assisting the bus.

Figure 4:
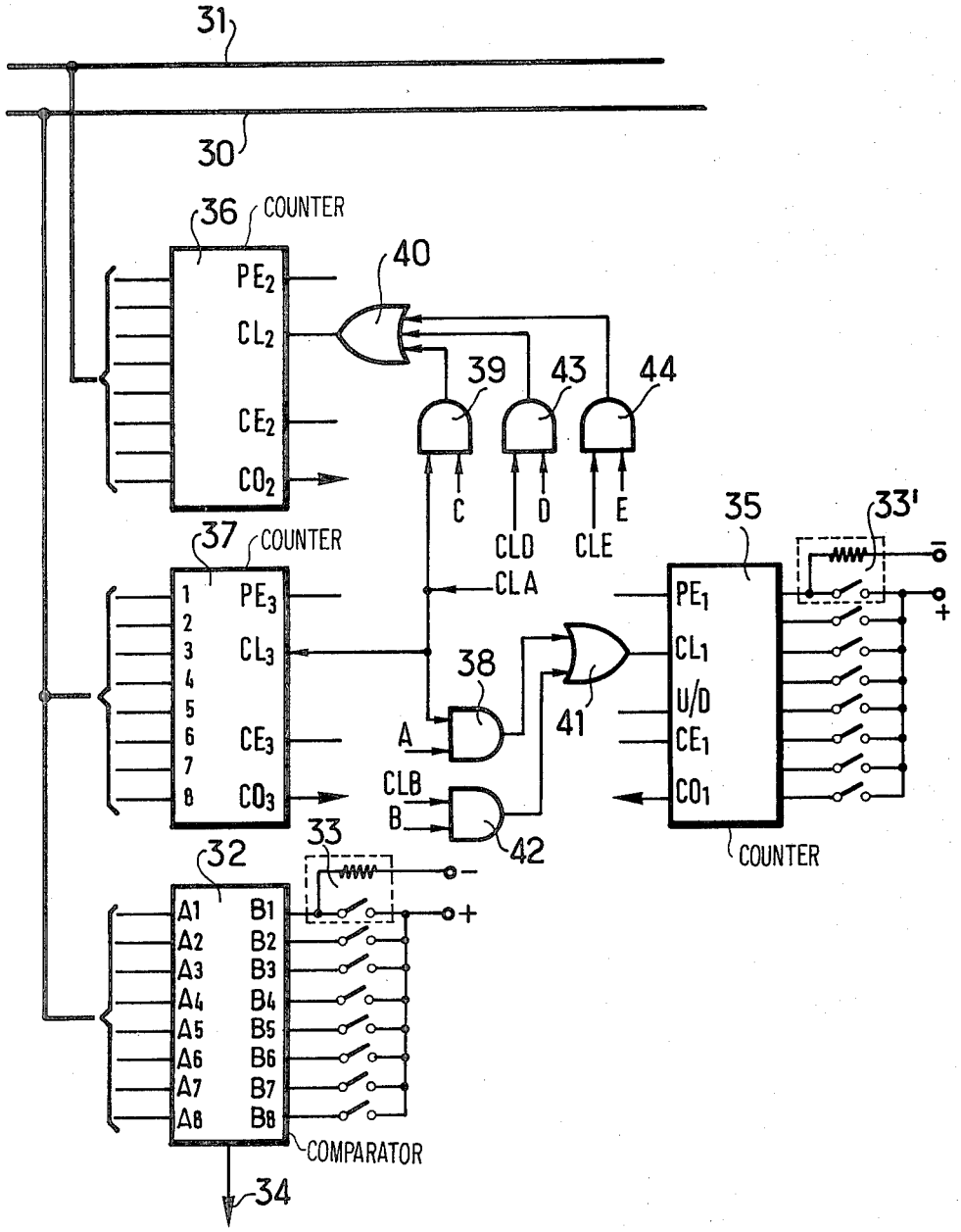
FIG. 4 is a block diagram of a part of the processing circuit of the electronic equipment of the beacon in FIG. 3.

FIG. 4 shows a part of the circuit for processing the signals of the early/late checking circuit 28. This circuit uses data transmitted by the bus: elapsed time since departure from the terminus (real travel time) 30, period after which the next bus should pass inter-bus interval 31 and the data recorded in situ at the beacon and coded by switches: theoretical travel time, maximum theoretical travel time.

In FIG. 4, it is seen that the real travel time data 30 is directed towards a comparator 32 by eight wires connected to inputs $A_1$–$A_8$ and having inputs $B_1$–$B_8$ receiving the switches (e.g. 33) coding of the maximum theoretical travel time in minutes in BCD code representing the number of units and of tens e.g. 80 minutes. If the real travel time 30 is fifty one minutes, A is less than B and the output 34 of the comparator 32 is in the logic state 1; if A is greater than B the output 34 of the comparator is in the logic state 0.

Thus, the checking unit, not shown, receives this 1 or 0 data and only takes the inter-bus interval into account in the case where the data is 0 (i.e. the bus is later than its theoretical maximum travel time).

In other words it is necessary to compare the real travel time with the maximum theoretical travel time. If the real travel time is greater than the maximum theoretical travel time, it is considered that there is an error and only the inter-bus interval is taken as the waiting time before the next bus passes.

For a real travel time less than the maximum, the following is calculated:

Theoretical travel time
+inter-bus interval
−real travel time
=waiting time before the next bus arrives.

These calculations are made by means of the central unit which, by means of the controls PE1,CE1, PE2, CE2,PE3, CE3 starts the counters 35,36 and 37. The counter 35 is coded by switches such as 33' to the theoretical travel time which can be, for example, fifty minutes.

The counter 36 receives the inter-bus interval 31 on eight wires, this interval could be ten minutes for example.

The counter 37 receives the real travel time 30 on eight wires, this real travel time being fifty one minutes in this example.

Under the control of signals A and C from the central unit a clock CLA delivers pulses at a certain frequency to the counters 35 and 36, these counters operating only when there are the signals A and C at the inputs of the AND gates 38 and 39.

The counter 36 counts down from ten to zero (for example) when the clock CLA sends it pulses via an OR gate 40 on the terminal CL2. The change to zero of the output CO2 indicates the end of the addition of the theoretical travel time and the inter bus interval.

The counter 37 connected directly to the clock CLA counts down in our example from fifty one to zero and the change to zero of the output CO3 indicates the end of the subtraction of the real travel time.

The counter 35 counts the clock pulses of the clock CLA on an order from the central unit (terminal U/D) and goes from fifty to sixty (for example) then counts down on an order sent to U/D and goes from sixty to nine (for example), this latter value representing the waiting time before the next bus is due to pass.

The waiting time is then counted down and the change to zero of the output CO1 of the counter 35 indicates that the waiting time is over. The counter 35 also receives on its terminal CL1, via an OR gate 41, the pulses of a clock CLB on order B of the central unit driving an AND gate 42 so as to allow the clock pulses CLB to pass in the case where B is in the logic state 1.

Likewise, the counter 36 is capable of receiving on its OR gate 40 the pulses of the clocks CLD and CLE which come from the AND gates 43 and 44. The frequency of the clock CLD is twice that of the clock CLB and that of the clock CLE is a sub-multiple of the frequency of the clock CLB such as in a ratio of 2 to 1 for example.

Consequently, a half-interval is counted down on the counter 36, for example, from ten to zero at twice the rate, at the same time as the waiting time is counted down. This counting down of a half-interval makes it possible to prevent several late buses from coming close behind one another in the case of a great disturbance. This compensates the rates and the travel time defined in the case of a disturbance and which could not have been otherwise corrected. In this way, the passing of a late bus immediately after a first bus is not facilitated.

As soon as the waiting time is zero at the output CO1, the time by which the next bus is overdue (time following the waiting time) is counted and as soon as the half-interval is zero (output CO2 of the counter 36) LATE BUS ANNOUNCEMENT data ARD is transmitted to the processing interface 29 to regulate the traffic lights so as to promote the prolongation of green lights on the road used by the bus.

As soon as the signal ARD is transmitted, generally, two intervals (for example) or a multiple of an interval are counted down. This is done by means of the clock CLE and in our example, the counter 36 counts down from ten to zero at half the rate.

When the count down of the two intervals reaches zero, the transmission of the signal ARD is stopped so as not to disturb the junction with data which is probably erroneous. Further, when the bus passes, the data ARD also disappears due to the fact that the presence signal of the bus emitter is picked up.

The system used makes it possible to affect the regulation of the traffic lights at the junction by facilitating the running of the vehicles upstream from the junction and the rapid crossing of the junction while hindering running of other vehicles as little as possible.

I claim:

1. A system for monitoring the travel of urban public transport vehicles over a route having several stops, said system comprising data transmission units disposed on each vehicle and a plurality of recording and signalling ground beacons spaced out along the route of the vehicles for receiving and processing data transmitted by said transmission units, each of said transmission units comprising:

first display means for storing the identification of the vehicle, its route and the optimum time for the next vehicle to pass, a first clock for measuring the real travel time of the vehicle since its departure from the terminus of the route, and encoding and transmitting means connected to said display means and said first clock for transmitting an encoded data signal representing the identification of the vehicle, its route, the optimum time for the next vehicle to pass and the real travel time of the vehicle, each of said recording and signalling ground beacons comprising:

receiving and decoding means for receiving said encoded data signal and providing output signals representative of the identification of the vehicle, its route, the optimum time for the next vehicle to pass and the real travel time of the vehicle, recording means for storing data representing the theoretical travel time for the identified vehicle and its route, a second clock for supplying clock pulses, a first counter connected to said recording means and preset to said theoretical travel time, a second counter connected to said receiving and decoding means and preset to said optimum time for the next vehicle to pass, a third counter connected to said receiving and decoding means and preset to said real travel time, gating means connected to said second clock for supplying clock pulses to said first, second and third counters so that said first counter counts up while said second counter counts down to zero and then counts down while said third counter counts down to zero, the count remaining on said first counter when said third counter counts to zero indicating the waiting time for the next bus, and second display means connected to said first counter for displaying the waiting time for the next vehicle.

2. A system for monitoring the travel of urban public transport vehicles as recited in claim 1, wherein said first counter counts down to zero unless interrupted by the arrival of the next vehicle, said second display means providing an indication of late bus when said first counter counts to zero.

3. A system for monitoring the travel of urban public transport vehicles as recited in claim 1, wherein each of said recording and signalling ground beacons further comprises:

second recording means for storing data representing the maximum theoretical travel time for the identified vehicle and its route, and comparing means connected to said receiving and decoding means and to said second recording means for comparing the real travel time with the maximum theoretical travel time and, if the real travel time exceeds the maximum theoretical travel time, providing an output which causes the optimum time for the next vehicle to pass to be displayed by said second display means as the waiting time for the next vehicle.

4. A system according to claim 1, wherein said ground beacons are disposed at road junctions regulated by traffic lights and are fitted with means for controlling the traffic lights to give priority to a vehicle which is late in relation to its theoretical travel time.

5. A system according to claim 1, wherein said system further comprises a control station and the ground beacons are fitted with units for transmitting data to said control station.

* * * * *